US006615619B2

(12) United States Patent
Kakuda et al.

(10) Patent No.: US 6,615,619 B2
(45) Date of Patent: Sep. 9, 2003

(54) DRUM-TYPE WASHING MACHINE

(75) Inventors: Masahiko Kakuda, Otsu (JP); Katsuhito Nakagawa, Otsu (JP); Kazushige Murakami, Koga-gun (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/813,163

(22) Filed: Mar. 21, 2001

(65) Prior Publication Data

US 2002/0020196 A1 Feb. 21, 2002

(30) Foreign Application Priority Data

Mar. 30, 2000 (JP) ..... 2000-093194

(51) Int. Cl.[7] ..... D06F 37/04

(52) U.S. Cl. ..... 68/24; 68/58; 68/140; 68/25

(58) Field of Search ..... 68/24, 25, 12.04, 68/12.14, 12.19, 58, 140, 12.06

(56) References Cited

U.S. PATENT DOCUMENTS

| | | | | |
|---|---|---|---|---|
| 1,757,417 | A | * | 5/1930 | Cowley |
| 1,886,201 | A | * | 11/1932 | Lange |
| 2,138,858 | A | * | 12/1938 | Hjelm |
| 2,391,634 | A | * | 12/1945 | Lewis et al. |
| 2,436,343 | A | * | 2/1948 | Wilson |
| 2,461,643 | A | * | 2/1949 | Hemmeter |
| 2,579,310 | A | * | 12/1951 | Dunham |
| 2,615,320 | A | * | 10/1952 | Belaieff |
| 2,645,548 | A | * | 7/1953 | Kreitchman et al. |
| 2,807,963 | A | * | 10/1957 | Osterhus et al. |
| 2,986,914 | A | * | 6/1961 | Bruken |
| 3,058,329 | A | * | 10/1962 | Searle |
| 3,060,764 | A | * | 10/1962 | Sibbald |
| 3,088,593 | A | * | 5/1963 | Stilwell, Jr. |
| 3,111,017 | A | * | 11/1963 | Searle |
| 3,385,085 | A | * | 5/1968 | Engel |
| 4,835,993 | A | * | 6/1989 | Dreher |
| 5,979,195 | A | * | 11/1999 | Bestell et al. |
| 6,401,284 | B1 | * | 6/2002 | Jeon et al. |

FOREIGN PATENT DOCUMENTS

| | | | |
|---|---|---|---|
| JP | 64-27589 | * | 1/1989 |
| JP | 64-32893 | * | 2/1989 |
| JP | 64-032893 | | 2/1989 |
| JP | 2-249586 | * | 10/1990 |
| JP | 2-249587 | * | 10/1990 |
| JP | 2-249591 | * | 10/1990 |
| JP | 03-086197 | | 4/1991 |
| JP | 05-293289 | | 11/1993 |
| JP | 11-216296 | | 8/1999 |

* cited by examiner

*Primary Examiner*—Frankie L. Stinson
(74) *Attorney, Agent, or Firm*—Oliff & Berridge, PLC

(57) ABSTRACT

In a drum-type washing machine according to the present invention, a drum 5 is inclined so that the opening 5*a* of the drum 5 is angled slightly upward. In the extracting process, a balancing operation is performed where the drum 5 is rotated at a speed lower than a speed where the centrifugal force and the gravitational force acting on the laundry are balanced, whereby the laundry in the drum 5 is moved toward the rear end and gathered there. Thus, even when there is an eccentric load due to an uneven distribution of the laundry around the rotation axis, it is highly probable that the position of the eccentric load along the axial direction is in the rear end of the drum 5. In this state, since the distance between the eccentric load and a bearing member 10 for supporting the drum 5 by a cantilevered structure is small, the shaking movement of the drum 5 is relatively small, and the load working on the bearing member 10 is also small. Thus, in the extracting process, abnormal vibration of the drum 5 or a tub 2 is assuredly prevented, and the load working on the bearing member 10 is reduced.

6 Claims, 9 Drawing Sheets

BEFORE DECELERATION

DURING DECELERATION

AT RESTORATION OF SPEED

DRUM-TYPE WASHING MACHINE

The present invention relates to a drum-type washing machine having a drum rotatable about a substantially horizontal axis. In particular, the present invention relates to a washing machine where an outer tub with a drum placed inside is oscillatably held by elastic members. The drum-type washing machine can be used not only for extracting water but also for extracting other liquids such as petroleum solvents from the laundry.

BACKGROUND OF THE INVENTION

In general, a drum-type washing machine has a cylindrical basket drum rotatable about a horizontal axis. When the drum is rotated at high speed with the wet laundry loaded therein, the water held by the laundry is extracted and scattered by a centrifugal force. One problem concerning such centrifugal extraction is that abnormal vibration and/or noise arises when the drum is rotated at high speed if the mass distribution around the rotation axis is unbalanced as a result of uneven distribution of the laundry on the inner circumferential wall of the drum.

Regarding the problem, various methods of balancing the load in the initial stage of the extracting process have been proposed. By one method, the eccentric load is reduced by evenly scattering the laundry in the circumferential direction of the drum. By another method, a weighing member having a fixed or variable weight is attached to a part of the drum so that the laundry and the weighing member are balanced for reducing the eccentric load. By those conventional washing machines, first the laundry is appropriately distributed or gathered on the circumferential wall of the drum to make the eccentric load of the drum as a whole smaller than a preset amount, and then the drum speed is raised to a high speed for a centrifugal extraction.

The conventional methods concern the load balance in the circumferential direction of the drum, i.e. the load balance around the rotation axis. The methods, however, do not concern the load balance along the rotation axis, i.e. in the direction of the depth of the cylindrical drum. In the drum-type washing machine, the drum is supported by a cantilevered structure where a horizontal rotation shaft fixed to the rear wall of the drum is rotatably held by a bearing member. By such a structure, even when the amount of the eccentric load in the circumferential direction is the same, if the eccentric load is located in the front part of the drum, the load that works on the bearing member in the high-speed extracting process is greater due to the larger distance between the bearing member and the eccentric load. According to the inventors' study concerning a washing machine where an outer tub with the drum placed inside is suspended by elastic members such as springs for absorbing oscillations, the oscillation of the outer tub becomes greater as the distance between the eccentric load and the bearing member becomes greater.

SUMMARY OF THE INVENTION

For addressing the above problems, one object of the present invention is to propose a drum-type washing machine constructed taking account of not only the magnitude of the eccentric load in the circumferential direction of the drum but also the position of the eccentric load in the axial direction of the drum, thus suppressing vibration or noise which is likely to occur when the drum is rotated at high speed.

Thus, in a drum-type washing machine wherein a shaft is rotatably held by a bearing member provided in an outer tub, a drum having a substantially cylindrical circumferential wall is fixed to an end of the shaft, and the drum is driven via the shaft to rotate about a central axis of the circumferential wall at high speed for extracting liquid from the laundry loaded in the drum, the drum-type washing machine according to the present invention is characterized in that the drum is placed so that the central axis of the drum is inclined downwards to a shaft-fixing end of the drum where the shaft is fixed, and a controller controls the rotation of the drum so that the laundry is moved toward the shaft-fixing end in the initial stage of the extracting process.

According to the present invention, the drum is postured so that the central axis is inclined downwards to the shaft-fixing end (or the rear end) of the drum. Therefore, when the laundry is agitated by, for example, rotating the drum, the laundry gradually moves along the inclined circumferential wall and finally comes close to the rear end of the drum. In this state, when the drum speed is raised higher than a specific speed where the centrifugal force and the gravitational force acting on the laundry are balanced (the speed is referred to as the "equilibrium speed" hereinafter), it is highly probable that the eccentric load, which is caused by an uneven distribution of the laundry on the circumferential wall of the drum, is located close to the shaft-fixing end. Thus, since the distance between the eccentric load and the bearing member is relatively small, the load that works on the bearing member during the high-speed rotation of the drum is relatively small, so that the wear or damage of the bearing member is decreased. Also, oscillation or vibration of the drum and the outer tub is suppressed while the drum is rotated at high speed.

For the purpose of gradually moving the laundry in the drum along the inclined circumferential wall, the drum may preferably be rotated at a speed slightly lower than the equilibrium speed. By this process, part of the laundry located close to the central axis is preferably scattered in the circumferential direction of the drum while being moved toward the rear end of the drum.

In a preferable mode of the present invention, the washing machine includes an eccentric load detector for detecting the magnitude or an index of the magnitude of the eccentric load due to an uneven distribution of the laundry around the central axis. In an embodiment of the invention, the eccentric load detector is constructed so that the eccentric load is detected based on a torque current component contained in a current supplied to the motor for rotating the drum under the condition that the drum is rotated at a preset speed. When the load around the central axis of the drum is unbalanced, the load torque changes within one rotation period of the drum, and the torque current component accordingly changes. The change corresponds to the magnitude and the position of the eccentric load in the circumferential direction of the drum. Thus, the magnitude of the eccentric load, or amount of eccentricity, can be detected from the change.

The washing machine having the above-described eccentric load detector may be constructed so that whether it is allowable to further raise the speed of the drum to carry out the extracting operation is determined by comparing the magnitude or index of the magnitude of the eccentric load to a preset reference value. By this construction, the drum is allowed to speed up only when the magnitude of vibration arising in the extracting process is expected to be below a preset allowable level. Thus, the vibration is assuredly suppressed in the extracting process.

By the washing machine according to the present invention, the eccentric load, if any, is assuredly located close to the bearing member, so that the reference value for determining whether or not to carry out the extracting process may be set greater than in the case where the eccentric load is far from the bearing member. This means that the allowable level of the amount of eccentricity is substantially greater. Therefore, the process of correcting the balance of the laundry, which conventionally requires a considerably long time, can be completed in a shorter time period.

The process of correcting the balance of the laundry in the initial stage of the extracting process may be such that the drum is simply rotated at a speed slightly lower than the equilibrium speed. Besides, in a preferable mode of the present invention, the washing machine is constructed so that, in the process of correcting the balance of the laundry, the speed of the drum is controlled by a method including steps of rotating the drum at a speed slightly higher than the equilibrium speed and temporarily reducing the speed to be lower than the equilibrium speed when the eccentric load rotating with the drum arrives at the top of the drum.

By the above construction, part of the gathered laundry causing the eccentric load falls off the circumferential wall of the drum due to the speed reduction, whereby the eccentric load is reduced effectively. In addition, since the drum is inclined, the part of the laundry comes closer to the bearing member when it falls onto the bottom of the drum. Thus, the above speed control is advantageous to the movement of the eccentric load toward the shaft-fixing end of the drum.

DETAILED DESCRIPTION OF PREFERRED EMBODIMENTS

[First Embodiment]

Figure 1:
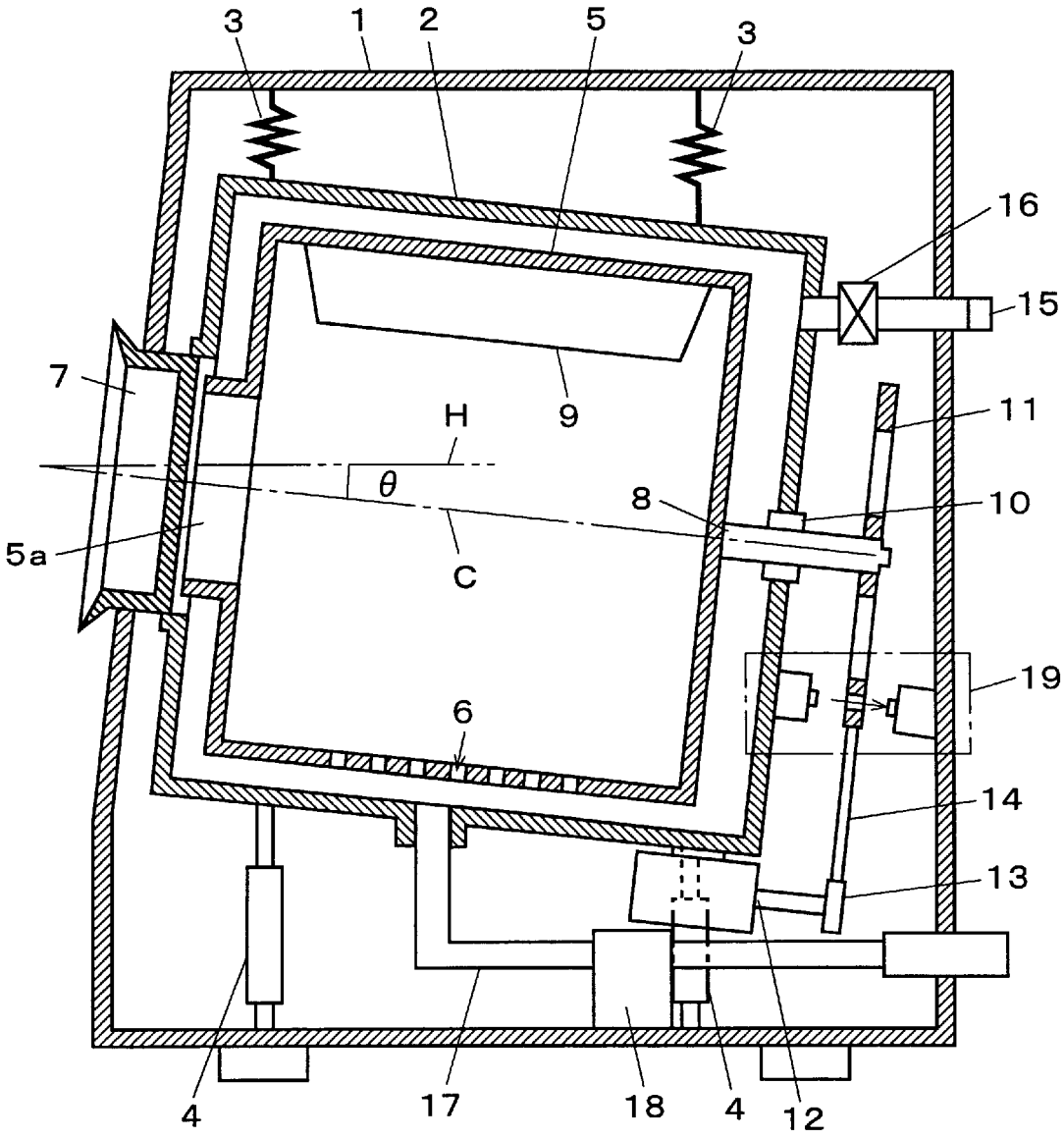
FIG. 1 shows a vertical section of a drum-type washing machine in a first embodiment of the present invention, viewed from a side.
Figure 2:
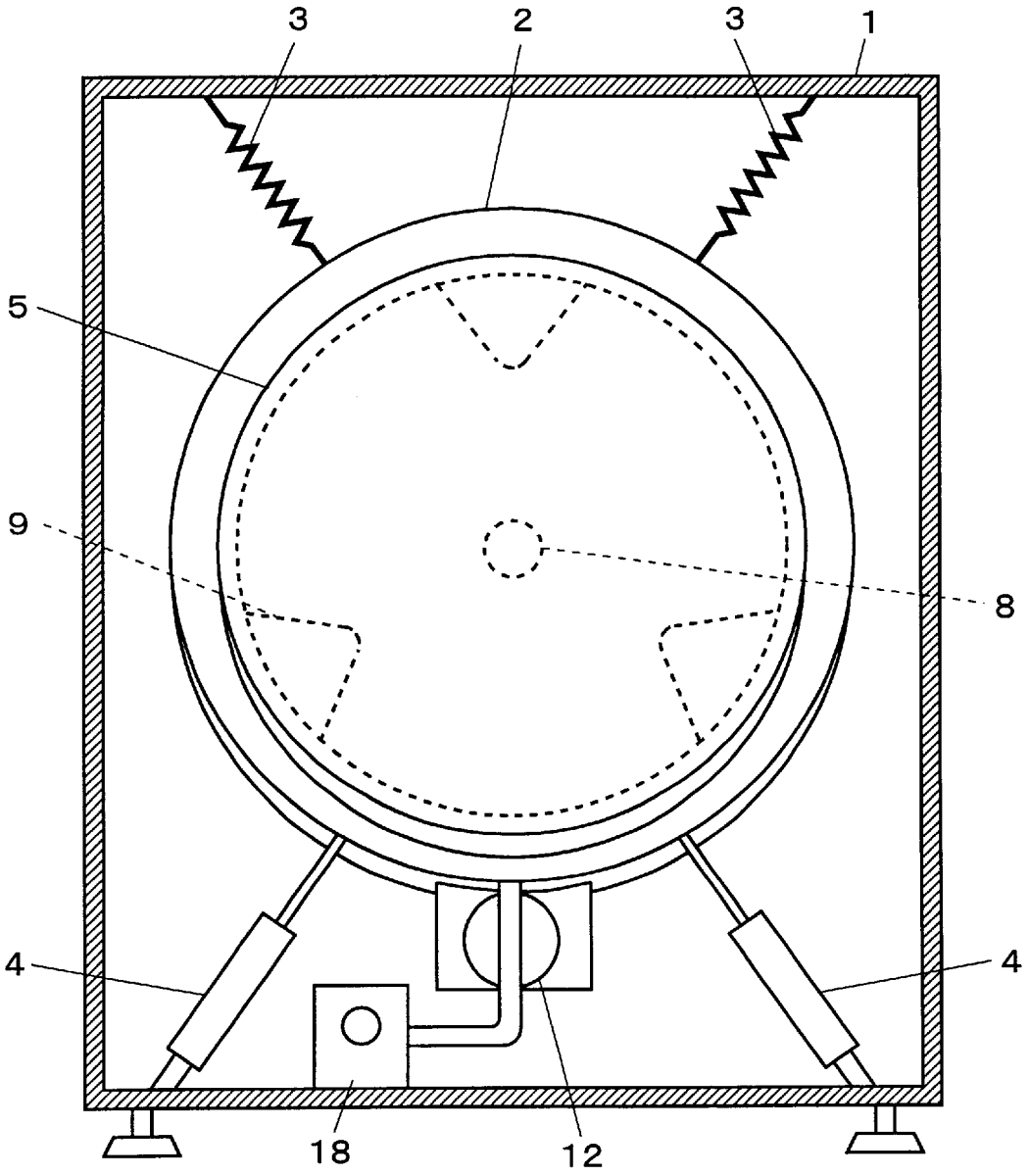
FIG. 2 shows the internal structure of the washing machine of the first embodiment, viewed from the front.

A first embodiment of the drum-type washing machine according to the present invention is described below.

The washing machine of the first embodiment has a body housing 1, in which an outer tub 2 having a substantially cylindrical wall is oscillatably held by four springs 3 and four dampers 4. In the outer tub 2, a cylindrical drum 5 for containing the laundry, having a substantially cylindrical wall, is mounted on a main shaft 8. A door 7 is provided in the front wall of the body housing 1 for closing the front opening 5*a* of the drum 5. The door 7 is opened when the laundry is to be loaded into the drum 5. A number of perforations 6 are formed in the circumferential wall of the drum 5. In the washing or rinsing process, when water is supplied into the outer tub 2, the water enters through the perforations 6 into the drum 5. In the extracting process, water extracted from the laundry is discharged from the perforations 6 to the outer tub 2. Baffles 9 for lifting the laundry are attached to the inner circumferential wall of the drum 5. In this embodiment, the baffles 9 are disposed at angular intervals of about 120 degrees.

The main shaft 8 is rotatably held by a bearing member 10 fixed in the outer tub 2. A main pulley 11 having a large diameter is attached to the rear end of the main shaft 8. A motor 12 is attached to the bottom of the outer tub 2, and a motor pulley 13 is fixed to the rotation shaft of the motor 12. The rotation of the motor pulley 13 is transmitted via a V-belt 14 to the main pulley 11. A pipe connection port 15 is provided at the back of the body housing 1, to which a water supply pipe (not shown) extending from an external water tap is connected. Water supplied via the water supply pipe flows through a water supply valve 16 and is supplied from a water-supply port placed at the back of the outer tub 2 into the outer tub 2. A drainage pipe 17 is connected to the bottom of the outer tub 2. When a drainage pump 18 provided in the drainage pipe 17 is energized, the water collected in the outer tub 2 is drained through the drainage pipe 17 to the outside.

A rotation sensor 19 consists of a photo-emitter attached to the outer tub 2 and a photo-detector attached to the body housing 1 across the main pulley 11. An opening is formed in the rim of the main pulley 11 at a position such that light emitted from the photo-emitter travels through the opening and reaches the photo-detector once in every rotation of the drum 5. Receiving the light, the photo-detector produces pulse signals synchronized with the rotation of the drum 5. It should be noted that the rotation sensor 19 may be differently constructed so long as it produces signals from which the rotational position of the drum 5 can be detected. For example, the rotation sensor 19 may be constructed using a magnetic sensor.

According to the present invention, the washing machine of the first embodiment is featured by that the outer tub 2 with the drum 5 placed inside is tilted backwards. That is, as shown in FIG. 1, the outer tub 2 is posed so that the central axis C of the drum 5 is inclined at an angle of $\theta$ from the horizontal line H. The reason for adopting such a position is as follows.

Figure 11A:
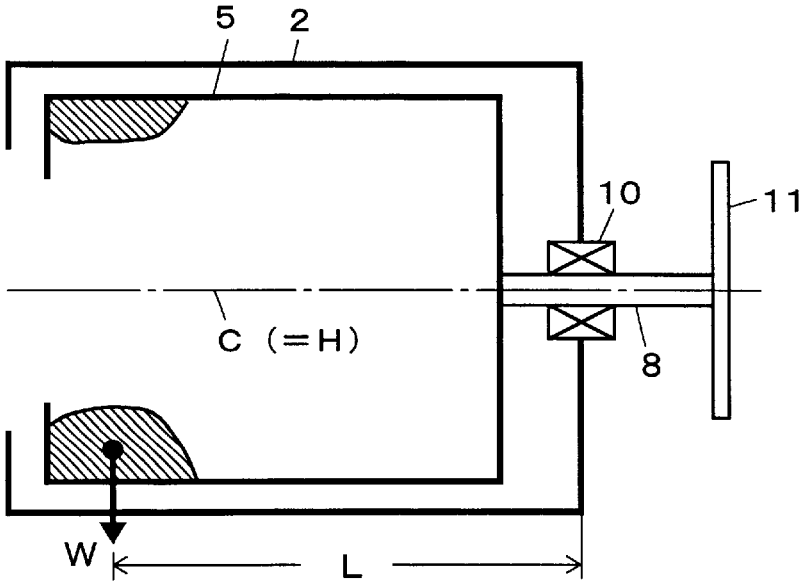
FIGS. 11A–11C are illustrations showing a conventional drum-type washing machine with eccentric loads existing in the drum.
Figure 11B:
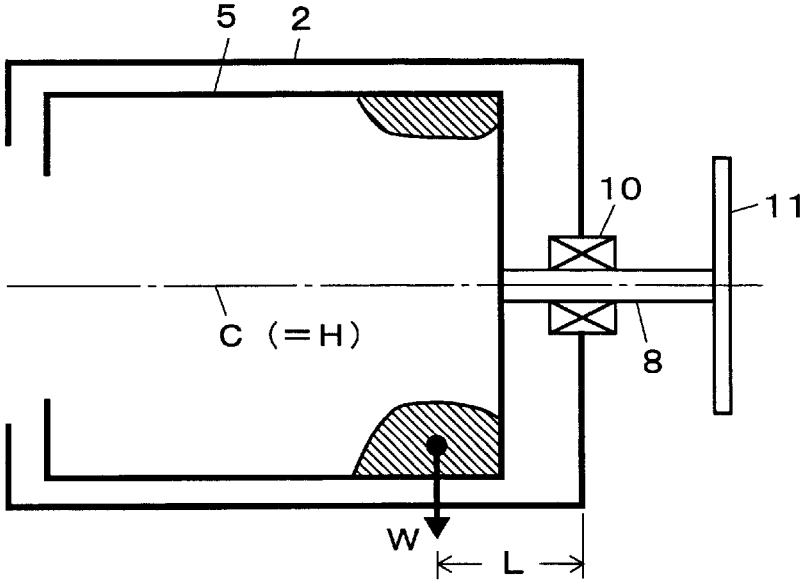
Figure 11C:
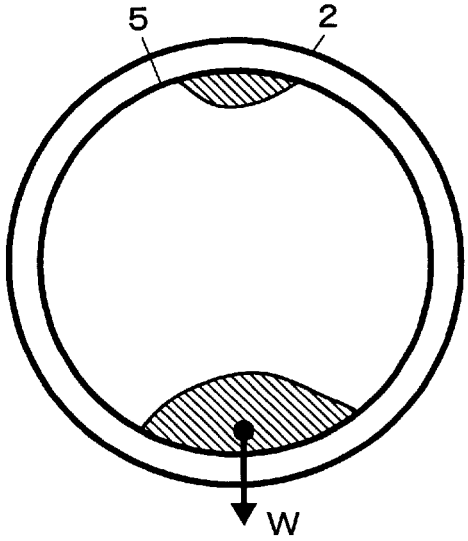

FIGS. 11A–11C show a conventional drum-type washing machine having a drum mounted on a substantially horizontal shaft, where an eccentric load exists due to an uneven distribution of the laundry. In conventional terms, to correct the balance of the drum 5 is to reduce the amount of eccentricity (W) due to the distribution of the laundry around the main shaft 8 as shown in FIG. 11C. When, however, the amount of eccentricity W in conventional terms is the same, the position of the eccentric load in the depth direction of the drum 5 may be different. For example, the eccentric load may be located in the front part of the drum 5 (as shown in FIG. 11A) or in the rear part of the drum 5 (as shown in FIG. 11B). It should be noted that the foregoing are the most extreme examples and actual eccentric load is intermediately located between the two extreme locations.

In the washing machine, the drum 5 is fixed to an end of the main shaft 8 and the main shaft 8 is cantilevered by the bearing 10. By such a construction, a heavy load works on the bearing member 10 due to the weight of the drum 5 and the laundry. When an eccentric load exists in the drum 5, the force to shake the drum 5 is greater as the distance L between the eccentric load and the bearing member 10 is greater. The shaking force is the same as a bending force working on the main shaft 8. The force exerted on the bearing member 10 in the case of FIG. 11A is stronger than in the case of FIG. 11B. The bearing member 10, normally consisting of ball bearings and other parts, may break by the strong force or, if not so, the life of the bearing member 10 shortens. Further, in the washing machine wherein the outer tub 2 is oscillatably supported by elastic members such as springs, the outer tub 2 oscillates violently when it receives the strong force through the bearing member 10, which causes vibration and noise of the washing machine. Therefore, in addition to reducing the amount of eccentricity W, it is desirable to make the eccentric load as close to the rear end of the drum 5 as possible, as shown in FIG. 11B.

Figure 3A:
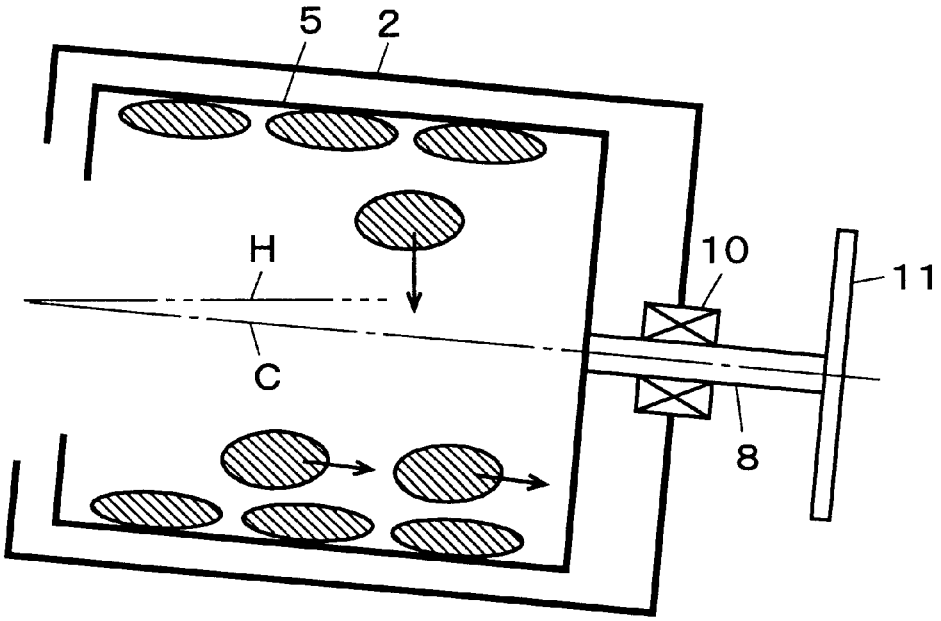
FIGS. 3A–3B are illustrations showing distributions of the laundry in the drum in the extracting process by the washing machine of the first embodiment.
Figure 3B:
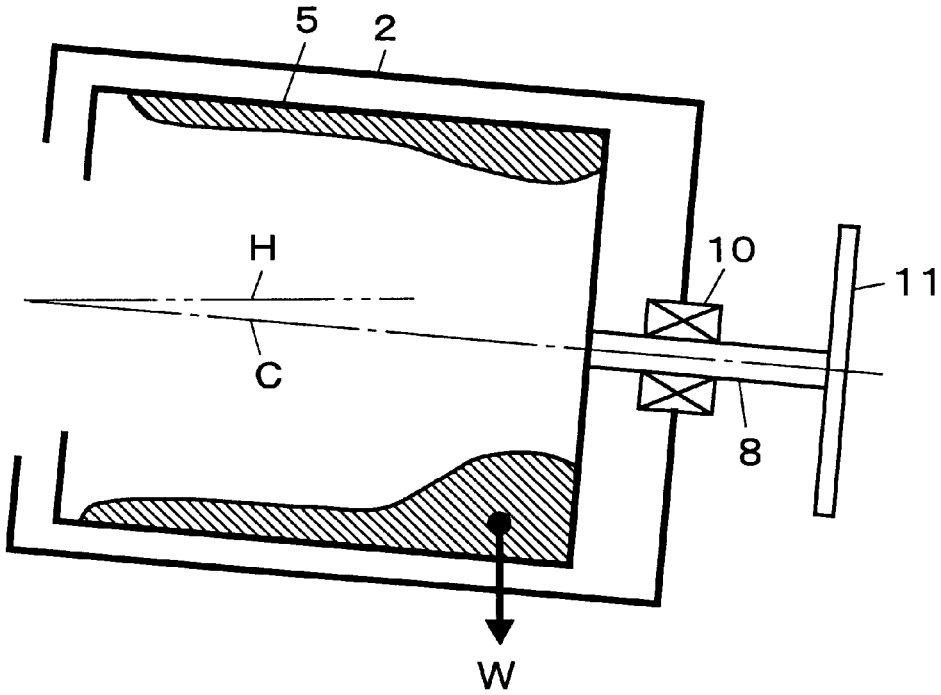

By the conventional washing machine as shown in FIGS. 11A–11C, it is impossible to control the distribution of the laundry along the central axis of the drum 5 because the drum 5 is postured so that the central axis lies substantially horizontal. By the washing machine of the first embodiment, on the other hand, the laundry in the drum 5 is easy to move rearward by the gravitational force because the drum 5 is postured to tilt backward. FIGS. 3A–3B are illustrations showing distributions of the laundry in the drum 5 in the extracting process by the washing machine of the first embodiment. When the drum 5 is appropriately rotated to agitate the laundry in the drum 5, the laundry gradually migrates to the rear end of the drum 5, as shown in FIG. 3A. As a result, the laundry is gathered in the rear part of the drum 5, as shown in FIG. 3B. In this state, if the laundry is unevenly distributed around the central axis of the drum 5, the eccentric load is located close to the rear end of the drum 5 and the bearing member 10. Thus, by the washing machine according to the present invention, the eccentric load can be brought into the rear part of the drum at high probability, a desirable position for suppressing the vibration and noise.

Figure 4:
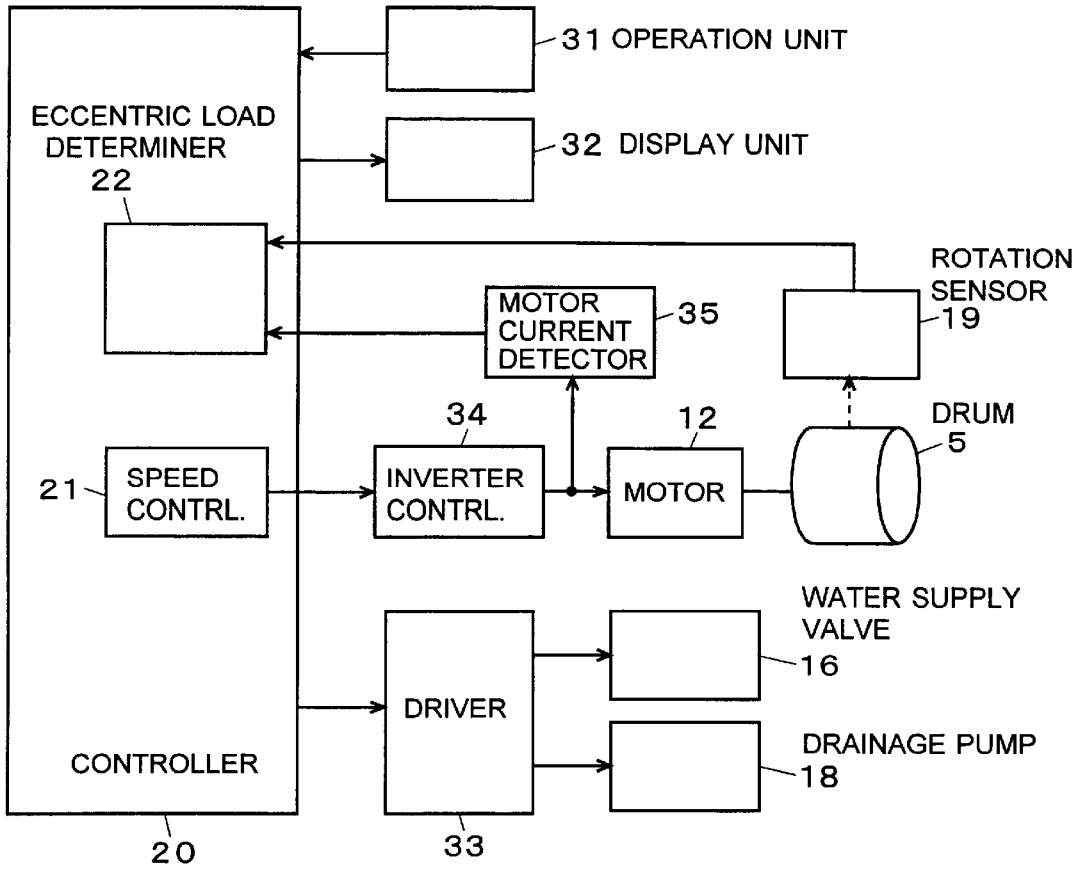
FIG. 4 is a block diagram showing the construction of the electrical system of the washing machine of the first embodiment.

FIG. 4 is a block diagram showing the construction of the electrical system of the washing machine of the first embodiment. A controller 20 for controlling the whole system includes a memory in which an operation program for carrying out washing, rinsing and extracting processes is stored beforehand. Connected to the controller 20 are operation unit 31, display unit 32, driver 33, inverter controller 34 and motor current detector 35. The operation unit 31 has an operation panel placed at the front end of the body housing 1. When a user makes an operation on the operation panel, the operation unit 31 sends a signal indicative of the operation to the controller 20. The display unit 32 includes a display panel placed at the front end of the body housing 1. The display unit 32 receives information relating to the operation by the user and/or the status of operation from the controller 20 and shows the information on the display panel.

The controller 20 functionally includes a speed controller 21 and an eccentric load determiner 22. The speed controller 21 sends a speed-designating signal to the inverter controller 34. The inverter controller 34 converts the signal to a pulse-width-modulated (PWM) signal and applies a driving voltage corresponding to the PWM signal to the motor 12. The motor 12 rotates at a designated speed and in a designated direction (back or forth), and the drum 5 rotates at a speed of a preset reduction ratio. The motor current detector 35 detects a torque current component contained in the driving current supplied to the motor 12 from the inverter controller 34. When the drum rotates at a speed where the laundry is pressed on the inner circumferential wall of the drum 5 by the centrifugal force, the load torque changes in the course of one rotation of the drum 5 if the laundry is unevenly distributed in the circumferential direction of the drum 5. Accordingly, in the course of one rotation of the drum 5, the torque current component contained in the motor current changes corresponding to the eccentric load due to the uneven distribution of the laundry.

Figure 5:
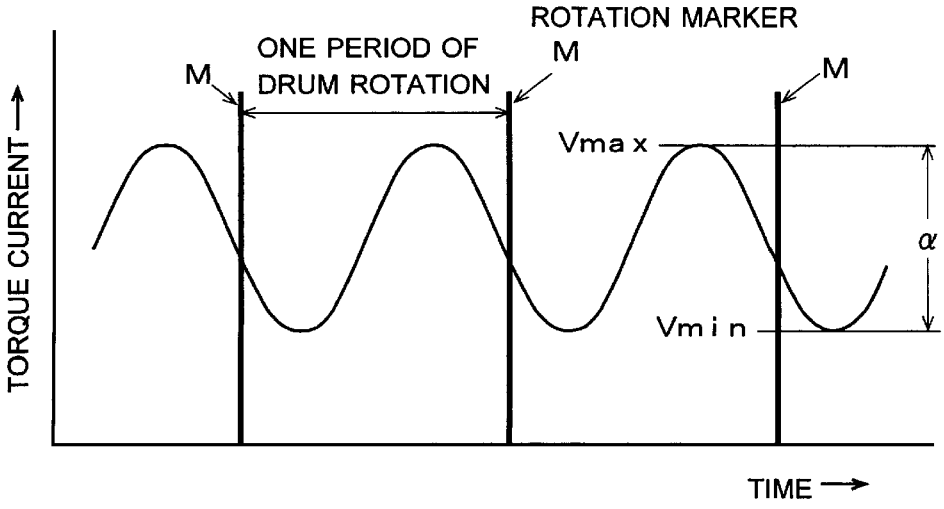
FIG. 5 is a graph showing rotation pulse signals produced by a rotation sensor and an example of waveform of torque current component changing due to the eccentric load in the washing machine of the first embodiment.

FIG. 5 is a graph showing rotation pulse signals (rotation markers) produced by the rotation sensor 19 and an example of wave form of torque current component changing due to an eccentric load. In each rotation of the drum 5, the maximum peak Vmax of the torque current component appears at a time point when the load torque is largest. In general, the load torque is largest within a time period when the laundry causing the eccentric load is being lifted against the gravitational force toward the top of the drum 5. Therefore, in general, the maximum peak Vmax appears within a time period when the eccentric load is within a range from the bottom to the side of the drum 5. The minimum peak Vmin of the torque current component, on the other hand, appears within a time period when the eccentric load is within a range from the top to the side of the drum 5. The difference $\alpha$ between the maximum peak value and the minimum peak value (i.e. $\alpha$=Vmax−Vmin), or the wave amplitude of the torque current component, reflects the magnitude of the eccentric load (or amount of eccentricity). The relation between the amount of eccentricity and the wave amplitude $\alpha$ of the torque current component is investigated beforehand, and a reference value is predetermined so that the amount of eccentricity at any time point can be evaluated by comparing the wave amplitude of the torque component at the time point to the reference value.

Referring to FIG. 4, the eccentric load determiner 22 receives waves from the motor current detector 35 and pulse signals from the rotation sensor 19, and determines by the above-described method whether the amount of eccentricity is less than a preset value.

Figure 6:
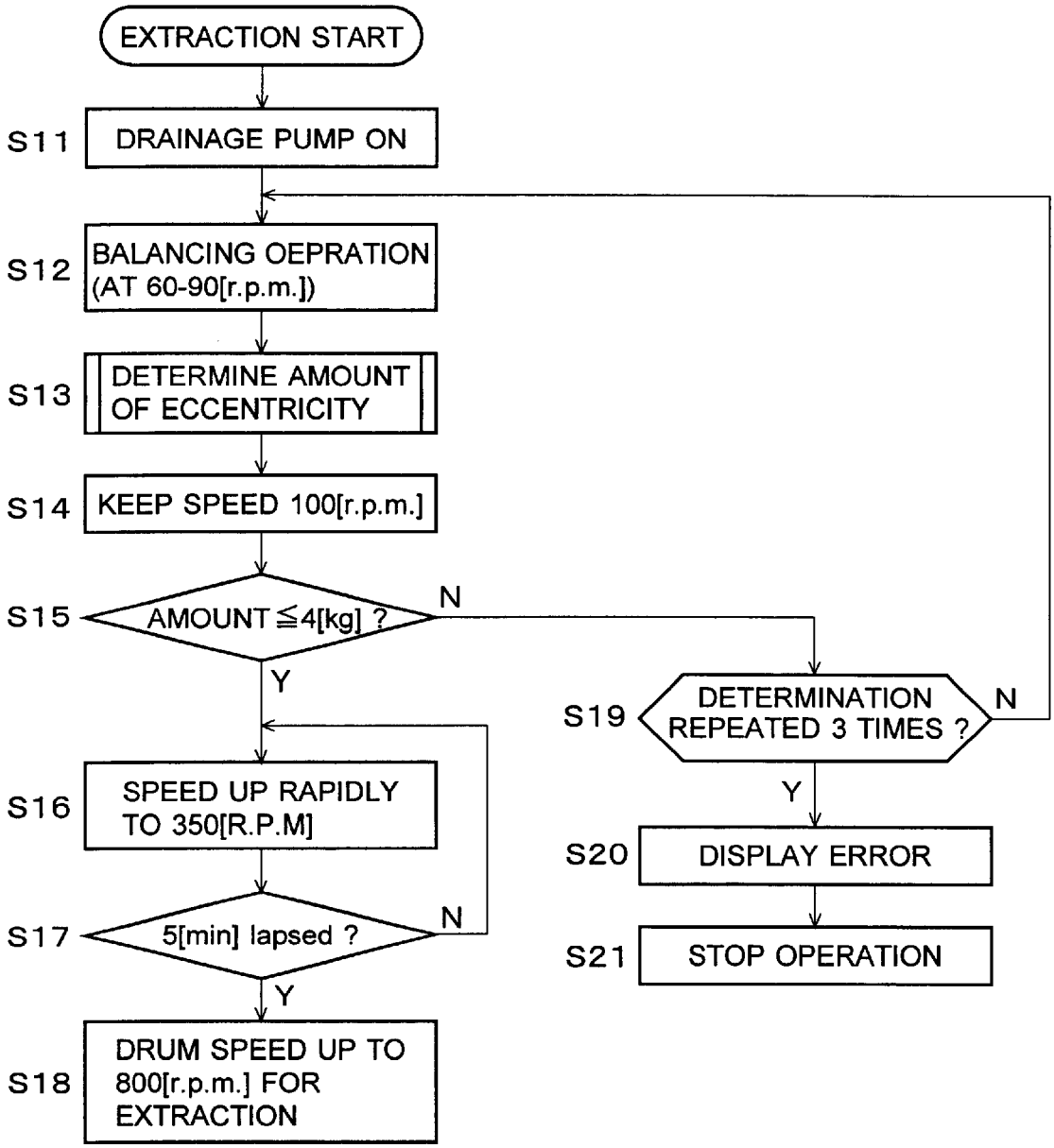
FIG. 6 is a flowchart showing control steps in the initial stage of the extracting process by the washing machine of the first embodiment.

Referring to FIG. 6, the extracting process carried out by the washing machine of the first embodiment is described below. The extracting process is carried out after a washing or rinsing operation. The extracting process may be a so-called intermediate extracting process or final extracting process.

After starting the extracting process, the controller 20 sends a command to the driver 33 to energize the drainage pump 18 to start draining water (Step S11). After completing the drainage, the speed controller 21 controls the motor 12 through the inverter controller 34 to carry out a balancing operation (Step S12). In the balancing operation, the drum 5 is rotated at speeds within a range slightly lower than the equilibrium speed where the centrifugal force and the gravitational force acting on the laundry are balanced. In this embodiment, the equilibrium speed is assumed to be 90 [r.p.m.], and the drum speed is controlled to change within the range of 60–85 [r.p.m.] in the balancing operation.

In the balancing operation, the behavior of the laundry depends on the distance from the central axis of the drum 5. Outer part of the laundry lying on the circumferential wall of the drum 5 keeps rotating with the drum 5 because an adequate centrifugal force acts on that part of the laundry. Inner part of the laundry, on the other hand, is not so strongly pressed on the circumferential wall of the drum 5 that it repeats stumbling while the drum 5 rotates. Through such an agitating process, the whole laundry changes the position along the inclined circumferential wall toward the rear end of the drum 5, as explained above. Also, the laundry is adequately scattered in the circumferential direction.

After carrying out the balancing operation for a preset time period, the amount of eccentricity is detected (Step S13). That is, the speed controller 21 sends a command to the inverter controller 34 to raise the speed of the drum 5 to a speed slightly higher than the equilibrium speed, 100 [r.p.m.], for example, and keeps the speed (Step S14). In this process, the whole laundry is pressed onto the circumferential wall of the drum 5 by the centrifugal force and rotates with the drum 5. In this state, the motor current detector 35 detects the torque current component and the eccentric load determiner 22, based on the torque current component, determines whether or not the magnitude of the eccentric load, or the amount of eccentricity, is less than a preset value (Step S15).

By the washing machine of the first embodiment, the laundry in the drum 5 is moved to the rear end of the drum 5. So, even when an eccentric load exists due to an uneven distribution of the laundry around the central axis, it is highly probable that the eccentric load is located in the rear part of the drum 5, as shown in FIG. 3B and that the distance between the eccentric load and the bearing member 10 is short. Thus, even when the amount of eccentricity is considerably large, the load that works on the bearing member 10, and so the oscillation or vibration of the outer tub 2 and the drum 5, are minimized.

Here, the reference value of the amount of eccentricity is assumed as 4 [kg]. In Step S15, the eccentric load determiner 22 determines whether the amount of eccentricity is less than 4 [kg] When it is less than 4 [kg], the speed of the drum 5 is rapidly raised to 350 [r.p.m.] (Step S16). Here, the drum speed corresponding to the frequency of natural oscillation of the outer tub 2 (or oscillation speed) is assumed as 250 [r.p.m.]. At the oscillation speed, the outer tub 2 oscillates or vibrates fiercely. By the above speed control, however, since the speed of the drum 5 rapidly passes the oscillation speed, fierce oscillation or vibration of the outer tub 2 and the drum 5 does not occur. After that, the drum speed is maintained for 5 seconds (Step S17), and then is raised to 800 [r.p.m.] (Step S18). After maintaining the speed for a preset time period, the extracting process is completed.

When, in Step S15, the amount of eccentricity is determined as greater than 4 [kg], it is highly probable that abnormal vibration or noise arises if the speed of the drum 5 is further raised. In such a case, the controller 20 determines whether the above determination process has already been repeated three times (Step S19). When the number of repetitions is less than three, the process returns to Step S12 to restart the initial stage of the extracting process. That is, the speed of the drum 5 is once reduced to be lower than the equilibrium speed, thus making the laundry fall off the circumferential wall of the drum 5 and promoting the redistribution of the laundry. When, in Step S19, the number of repetitions is three, it is assumed that an abnormality has occurred in the initial stage of the extracting process. So, the controller 20 commands the display unit 32 to show an error message (Step S20). The controller 20 may further produce a warning sound with a buzzer or the like, if necessary. After that, the controller 20 stops the whole operation (Step S21).

Thus, by the drum-type washing machine of the first embodiment, even when an eccentric load exists due to an uneven distribution around the central axis of the drum 5, the eccentric load is brought close to the bearing member 10, so that the load on the bearing member 10 as well as vibration of the outer tub 2 and the drum 5 become relatively small. So, for example, the reference value used for the determination in Step S15 may be set relatively large. This means that the allowable level of the amount of eccentricity is relatively great. Thus, the probability that the balancing operation needs to be repeated becomes smaller, so that the time period required for the extracting process is shortened. Also, the probability of an error of the extracting process becomes smaller.

[Second Embodiment]

Figure 7:
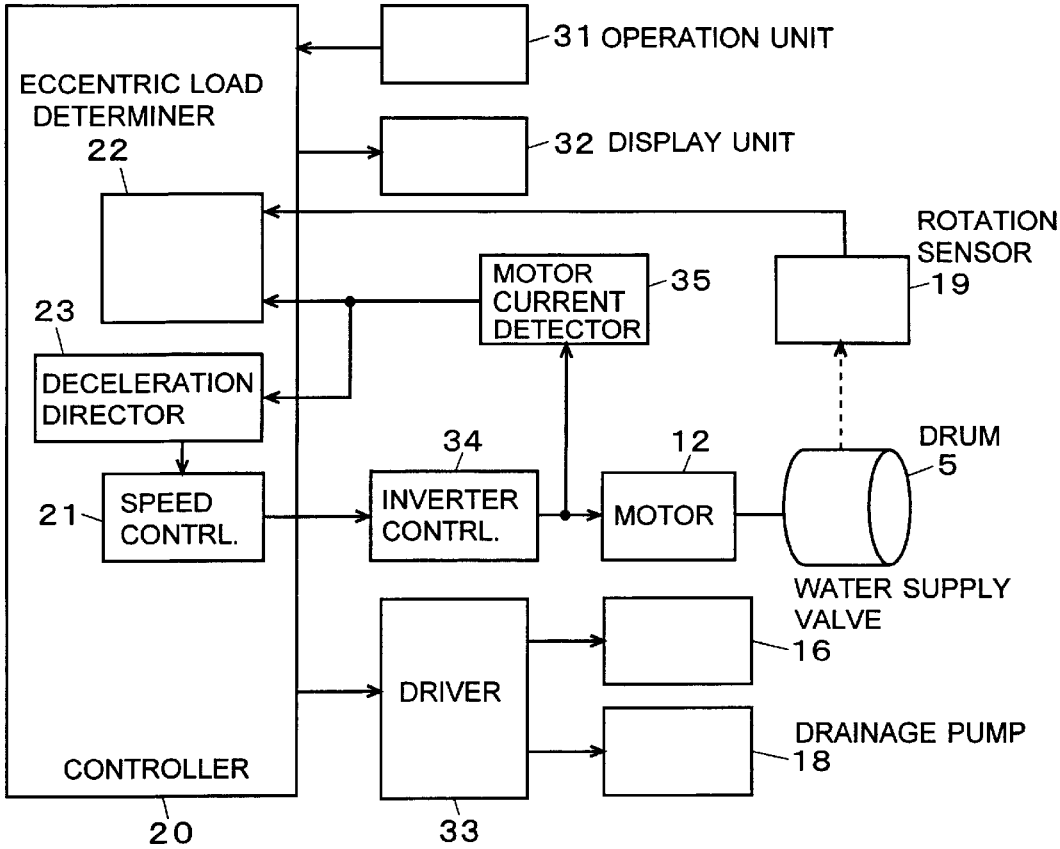
FIG. 7 is a block diagram showing the construction of the electrical system of a washing machine of a second embodiment of the present invention.

A second embodiment of the washing machine of the present invention is described below. The mechanical structure of the washing machine of the second embodiment is the same as in the first embodiment, so that the structure is not explicitly described in the following. FIG. 7 is a block diagram showing the electrical system of the washing machine of the second embodiment. The basic construction of the electrical system is the same as in the first embodiment, and the only difference is that the controller 20 of the second embodiment includes a deceleration director 23. So, the function of the deceleration director 23 is explained first.

As explained referring to FIG. 5, when en eccentric load exists in the drum 5, the torque current component in the motor current periodically changes synchronized with the rotation of the drum 5, and the maximum peak appears at a time point when the load torque is largest in each rotation of the drum 5. In general, the load torque is largest within a time period when the eccentric load is being lifted against the gravitational force toward the top of the drum 5. Therefore, in most cases, the maximum peak of the torque current component appears within a time period when the eccentric load is being lifted from the bottom to the side of the drum 5. An efficient method of evenly scattering the laundry around the axis of the drum 5 is to break a part of the piled-up laundry causing the eccentric load and make it fall. So, the deceleration director 23 detects the maximum peak from the wave signal of the torque current component, and produces a pulse signal at a timing delayed by a preset length of time from the detection of the maximum peak. When the length of time period is preset appropriately, the pulse signal is produced at a time point when the eccentric load is at the top of the drum 5. This pulse signal is called here a deceleration-directing signal. On receiving the deceleration-directing signal, the speed controller 21 works to temporarily reduce the speed of the drum 5.

Figure 8:
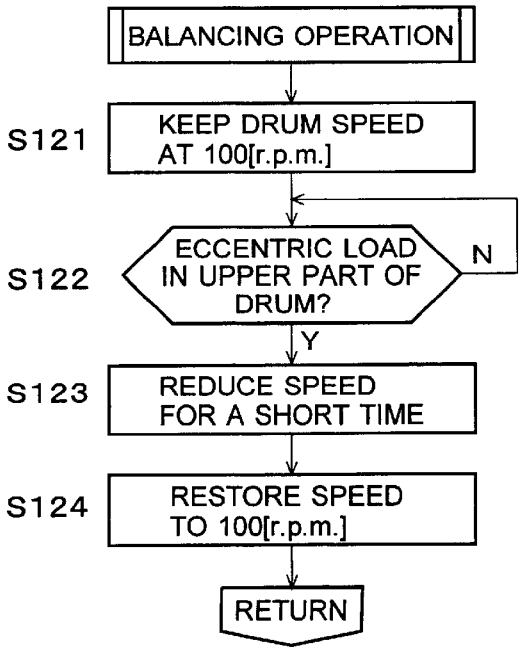
FIG. 8 is a flowchart showing control steps of the balancing operation in the extracting process by the washing machine of the second embodiment.
Figure 9A:
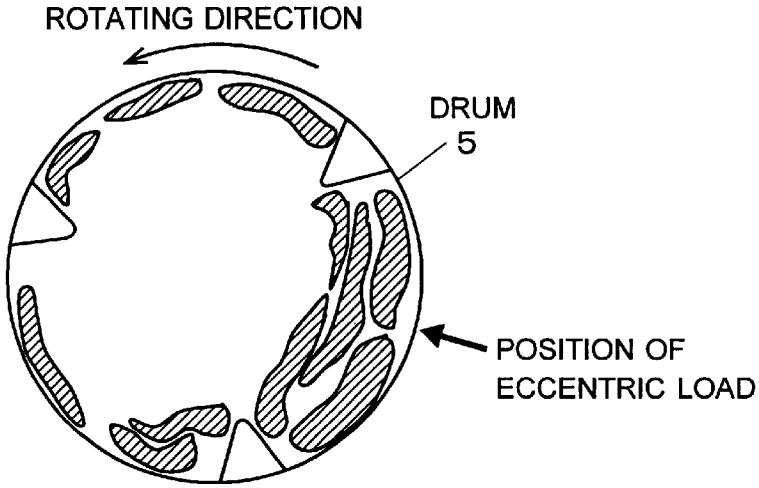
FIGS. 9A–9C are illustrations showing the distribution of the laundry in the circumferential direction in the drum of the washing machine of the second embodiment.
Figure 9B:
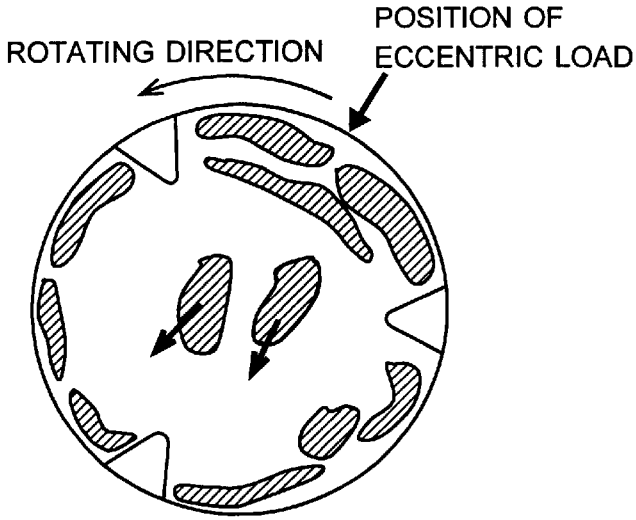
Figure 9C:
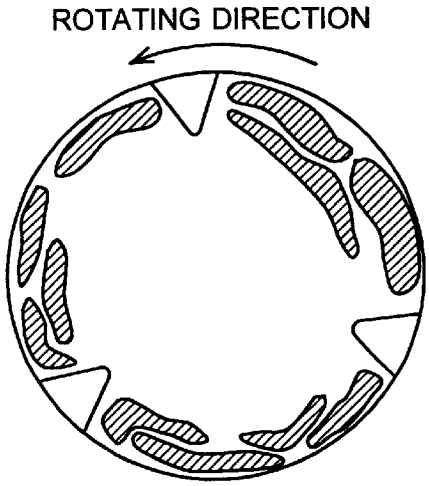
Figure 10:
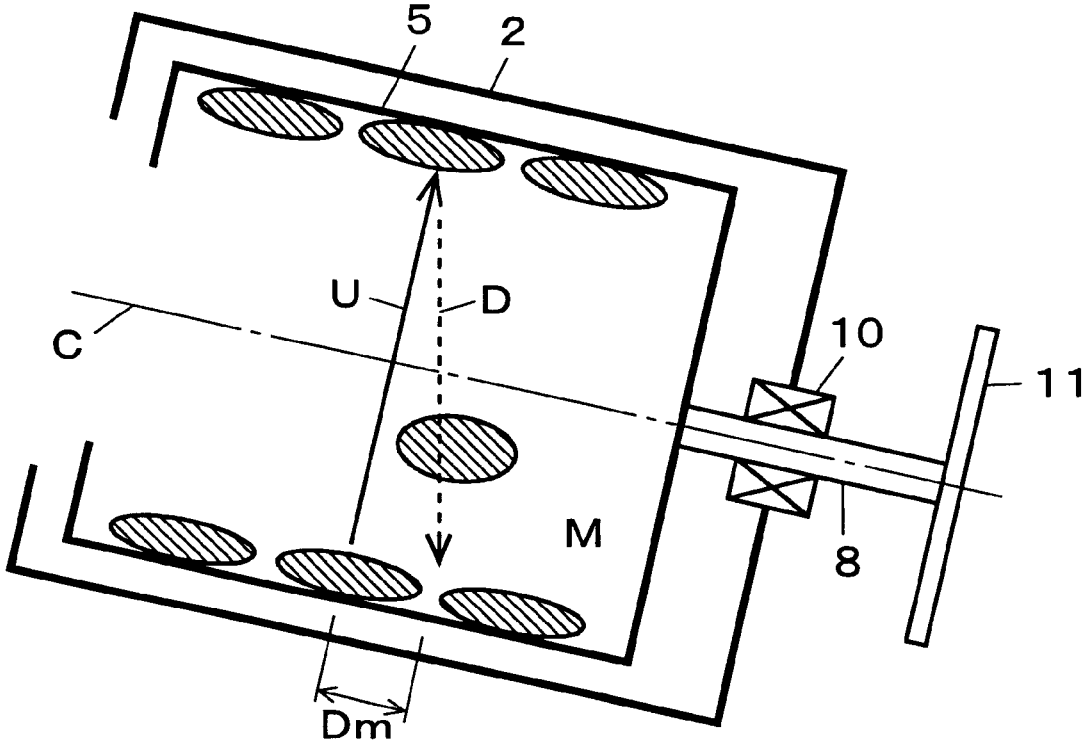
FIG. 10 is an illustration showing the distribution of the laundry along the axial direction in the drum of the washing machine of the second embodiment.

As for the extracting process by the washing machine of the second embodiment, the control method is basically the same as shown in FIG. 6 of the first embodiment, and the only difference is that the balancing operation in Step S12 of the flowchart is performed in a different manner. FIG. 8 is a flowchart showing control steps of the balancing operation by the washing machine of the second embodiment. In the following part, the balancing operation by the washing machine is described along with FIG. 8 and further referring to FIGS. 9A–10. FIGS. 9A–9C are illustrations showing a distribution of the laundry in the circumferential direction of the drum 5, and FIG. 10 is an illustration showing a distribution of the laundry in the axial direction of the drum 5.

Using the inverter controller 34, the speed controller 21 drives the motor 12 to keep the drum 5 at a first speed slightly higher than the equilibrium speed, 100 [r.p.m.], for example (Step S121). When the drum 5 is rotated at 100 [r.p.m.], all the laundry is pressed on the circumferential wall of the drum 5 by the centrifugal force and rotates with the drum 5 (FIG. 9A). If an eccentric load exists due to an uneven distribution of the laundry around the axis of the drum 5, the torque current component changes corresponding to the position of the eccentric load. When the eccentric load is being lifted after passing the side of the drum 5 (i.e. when the eccentric load is in the upper part of the drum 5), the deceleration director 23 sends a deceleration-directing signal to the rotation controller 21 (Step S122). On receiving the signal, the speed controller 21 produces a speed-designating signal corresponding to a second speed lower than the first speed, 60 [r.p.m.] for example, for a preset short time period, whereby the speed of the drum 5 is temporarily reduced (Step S123).

The objective of the above-described rapid deceleration is to decrease the centrifugal force acting on the laundry being pressed on the circumferential wall of the drum 5 and rotating with the drum 5 so that the gravitational force temporarily overcomes the centrifugal force. When the drum 5 is decelerated at a time point when the mass of the laundry arrives at the top of the drum 5, the laundry falls and is broken into pieces (FIG. 9B). Since the centrifugal force acting on a laundry article is proportional to the distance between the article and the rotation axis, laundry articles lying closer to the rotation axis experiences smaller centrifugal forces. Therefore, when the drum 5 is decelerated from a speed where every laundry article experiences a centrifugal force greater than a gravitational force, those articles lying closer to the rotation axis fall earlier than the other articles. Thus, by performing the deceleration with appropriately preset second speed and time period, only a part of the laundry lying closer to the axis can be made to fall, while the other part of the laundry lying on the circumferential wall keeps rotating with the drum 5.

After the deceleration for the short time period, the speed of the drum 5 is rapidly restored to 100 [r.p.m.] (Step S124). Since the laundry having caused the eccentric load in the previous stage is now moderately scattered, the amount of eccentricity is smaller than before the deceleration (FIG. 9C).

In the washing machine of the second embodiment, when a laundry article is lifted from the bottom to the top of the drum 5, the laundry article moves as denoted by arrow U in FIG. 10. After arriving at the top of the drum 5 where the drum 5 is decelerated and the gravitational force acting on the laundry article overcomes the centrifugal force, the laundry article falls as denoted by arrow D in FIG. 10. The laundry article falls onto the bottom of the drum 5 at a position displaced by a distance Dm from the original position toward the rear end of the drum 5. Thus, by the washing machine of the second embodiment, the laundry moves toward the rear end of the drum 5 every time it falls at the deceleration as described above. Therefore, even when an eccentric load remains as a result of an inadequate balance correction around the axis, it is highly probable that the eccentric load is brought into the rear part of the drum 5.

By the washing machine of the second embodiment, the scattering of the laundry is carried out aiming at such laundry articles that mainly cause the eccentric load. Therefore, it is highly probable that the eccentric load becomes smaller than in the washing machine of the first embodiment, so that the vibration is more assuredly suppressed, and the time period required for the extracting process is shortened.

It is obvious that the above embodiments are mere examples and may be changed or modified within the scope of the present invention. For example, in the washing machines of the above embodiments, the outer tub 2 is oscillatably suspended by the springs 3 and dampers 4. The oscillation-allowing structure may be such that the outer tub 2 is mounted on springs placed underneath. It is also possible that the outer tub 2 is fixedly placed in the body housing 1 without allowing oscillations.

Though the washing machines of the above embodiments use water for washing the laundry, it is obvious to the person skilled in the art that the present invention is applicable to a dry cleaning machine using petroleum solvents.

What is claimed is:

1. A drum-type washing machine, comprising:

an outer tub;

a shaft rotatably held by a bearing member provided in the outer tub;

a drum having a substantially cylindrical circumferential wall and a shaft fixing end fixed to an end of the shaft, wherein the drum is driven via the shaft to rotate about a central axis of the circumferential wall at high speed for extracting liquid from a laundry loaded in the drum and wherein the drum is postured so that the central axis is inclined downwards to the shaft-fixing end of the drum; and a controller for controlling the rotation of the drum about its central axis so that the laundry is moved toward the shaft-fixing end in an initial stage of an extracting process.

2. The washing machine according to claim 1, wherein the drum is rotated at a speed slightly lower than an equilibrium speed where a centrifugal force and a gravitational force acting on the laundry are balanced, so that the laundry in the drum is moved toward the shaft-fixing end of the drum.

3. The washing machine according to claim 2, further comprising an eccentric load detector for detecting a magnitude or an index of the magnitude of the eccentric load due to an uneven distribution of the laundry around the central axis.

4. The washing machine according to claim 3, wherein the eccentric load detector is constructed so that the eccentric load is detected based on a torque current component contained in a current supplied to a motor for rotating the drum under a condition that the drum is rotated at a preset speed.

5. The washing machine according to claim 3, further comprising a determiner for determining whether it is allowable to further raise the speed of the drum to carry out the extracting process by comparing the magnitude or index of the magnitude of the eccentric load to a preset reference value.

6. The washing machine according to claim 2, wherein, for correcting a balance of the laundry, the speed of the drum is controlled by a method including steps of rotating the drum at a speed slightly higher than the equilibrium speed and temporarily reducing the speed to be lower than the equilibrium speed when the eccentric load rotating with the drum arrives at the top of the drum.

* * * * *